US008524140B2

(12) United States Patent
Kurokawa et al.

(10) Patent No.: US 8,524,140 B2
(45) Date of Patent: Sep. 3, 2013

(54) PROCESS OF MAKING NANOFIBERS

(75) Inventors: Takahiro Kurokawa, Osaka (JP); Hiroto Sumida, Nara (JP); Kazunori Ishikawa, Osaka (JP); Masahide Yokoyama, Osaka (JP)

(73) Assignee: Panasonic Corporation, Osaka (JP)

( * ) Notice: Subject to any disclaimer, the term of this patent is extended or adjusted under 35 U.S.C. 154(b) by 273 days.

(21) Appl. No.: 13/062,123

(22) PCT Filed: Sep. 10, 2009

(86) PCT No.: PCT/JP2009/004480

§ 371 (c)(1), (2), (4) Date: Mar. 3, 2011

(87) PCT Pub. No.: WO2010/038362

PCT Pub. Date: Apr. 8, 2010

(65) Prior Publication Data

US 2011/0156319 A1 Jun. 30, 2011

(30) Foreign Application Priority Data

Oct. 2, 2008 (JP) ..... 2008-257474

(51) Int. Cl.
*D01D 5/18* (2006.01)
*D06M 10/00* (2006.01)
*H05B 7/00* (2006.01)

(52) U.S. Cl.
USPC ..... 264/465; 264/211.1

(58) Field of Classification Search
USPC ..... 264/10, 211.1, 464, 465, 466, 484
See application file for complete search history.

(56) References Cited

U.S. PATENT DOCUMENTS

| | | | | |
|---|---|---|---|---|
| 5,523,032 | A | 6/1996 | Ault et al. | |
| 2005/0287366 | A1 | 12/2005 | Okuzaki et al. | |
| 2006/0228435 | A1 | 10/2006 | Andrady et al. | |
| 2009/0127748 | A1 | 5/2009 | Takahashi | |
| 2010/0072674 | A1 * | 3/2010 | Takahashi et al. | 264/465 |
| 2012/0135448 | A1 * | 5/2012 | Parker et al. | 264/211.1 X |

FOREIGN PATENT DOCUMENTS

| | | |
|---|---|---|
| JP | 10-511338 | 11/1998 |
| JP | 2005-330624 | 12/2005 |
| JP | 2007-532790 | 11/2007 |
| JP | 2008-031624 | 2/2008 |
| JP | 2008-174853 | 7/2008 |
| WO | WO 2008/062784 A1 | 5/2008 |

* cited by examiner

*Primary Examiner* — Leo B Tentoni
(74) *Attorney, Agent, or Firm* — McDermott Will & Emery LLP

(57) ABSTRACT

A container having a plurality of orifices in an outer peripheral wall and having a space communicating with the orifices is rotated to extrude an electrically charged raw material liquid containing a polymer material from the space through the orifices by centrifugal force. This allows the electrically charged raw material liquid to form a fibrous material. At this time, the raw material liquid is supplied to the space in which the raw material liquid is filled by a raw material liquid pump so that the raw material liquid is extruded from the orifices at a predetermined pressure. That is, the raw material liquid in the space is pressurized. Also, the shape of the space in the container is set so that the centrifugal force exerted on the raw material liquid is constant.

2 Claims, 8 Drawing Sheets

PROCESS OF MAKING NANOFIBERS

TECHNICAL FIELD

This invention relates to a method and apparatus for producing nanofibers, and more particularly to a technique for producing nanofibers utilizing electrospinning.

BACKGROUND ART

Recently, electrospinning (charge induction spinning) has been receiving attention, since it enables easy production of nanofibers, which are fibrous material having submicron scale diameters. According to electrospinning, a raw material liquid comprising a polymer material dispersed or dissolved in a solvent is extruded into the air. When a high voltage is applied to the raw material liquid to extrude it, the raw material liquid becomes electrically charged, and the raw material liquid is electrically drawn in the air to form nanofibers (see, for example, PTL 1).

More specifically, while the raw material liquid, electrically charged by the electric field and extruded into the air, is traveling in the air, the solvent evaporates and the volume of the raw material liquid decreases. However, the electrical charge of the raw material liquid is retained despite the evaporation of the solvent. Thus, the charge density of the raw material liquid increases as the solvent evaporates. When the repulsive Coulomb force in the raw material liquid overcomes the surface tension of the raw material liquid, the raw material liquid is explosively drawn linearly (hereinafter referred to as electrostatic drawing). Such electrostatic drawing occurs continuously in the air, and the raw material liquid is subdivided geometrically, thereby resulting in formation of microfibers with submicron scale diameters.

Also, PTL 2 proposes an apparatus for producing nanofibers by electrospinning, in which a raw material liquid is extruded from a rotatable container. As illustrated in FIG. 9, this apparatus includes: a spray head 102 having at least one extrusion element 101 in the peripheral wall; and a cylindrical collecting member 103 containing the spray head 102. A voltage is applied between the spray head 102 and the collecting member 103 by a high voltage power source 104 to generate an electric field therebetween. In this state, the spray head 102 is rotated. As a result, a raw material liquid 106 supplied into the spray head 102 through a passage 105 is extracted from the tips of the extrusion elements 101 by the electric field to produce nanofibers. The produced nanofibers are deposited and collected on the inner surface of the collecting member 103.

Also, PTL 3 proposes a technique in which a cylindrical container having a large number of orifices in the peripheral wall is rotated to extrude a raw material liquid for forming nanofibers from the orifices by centrifugal force. In PTL 3, as illustrated in FIG. 10, a raw material liquid 114 for forming nanofibers is supplied to a cylindrical container 111 having a large number of orifices 113 in the peripheral wall through a supply pipe 112 having holes 112*a* in the peripheral wall. The container 111 is rotated to extrude the raw material liquid 114 from the orifices 113 by centrifugal force.

Also, the present inventors have developed and carried out a technique as shown in PTL 4 (see FIG. 11), in which an annular electrode 122 is disposed around a grounded cylindrical container 121 and a high voltage is applied therebetween. This technique makes it possible to induce a larger electrical charge on the container 121, and thus to give a sufficient electrical charge for electrostatic drawing to a raw material liquid jetted from the orifices of the container 121 even if the amount of the jet changes slightly. It therefore becomes possible to produce high quality nanofibers containing no clumps of raw material polymer.

The traveling direction of the raw material liquid extruded radially in the radial direction of the container 121 is deflected by air streams 123 which are substantially perpendicular thereto. Ahead of the deflected raw material liquid is a grounded drum 124. Since the drum 124 is electrically charged due to the application of the high voltage to the annular electrode 122, the raw material liquid or the fibrous material formed therefrom is attracted to the drum 124. A long-strip like collecting member 125 is disposed between the container 121 and the drum 124. The fibrous material attracted to the drum 124 is deposited and collected on the collecting member 125 which is transported in the longitudinal direction.

CITATION LIST

Patent Literatures

PTL 1: Japanese Laid-Open Patent Publication No. 2005-330624

PTL 2: Japanese Laid-Open Patent Publication No. 2007-532790

PTL 3: Japanese Laid-Open Patent Publication No. 2008-31624

PTL 4: Publication of WO 2008-062784

SUMMARY OF INVENTION

Technical Problem

As described above, in the apparatus of PTL 2, the raw material liquid for forming nanofibers is extruded from the nozzles (extrusion elements 101) disposed in the peripheral wall of the cylindrical container (spray head 102). Hence, a sufficient electrical charge can be given to the raw material liquid at the tips of the nozzles where the electrical charge is concentrated. It is thus possible to give the raw material liquid a sufficient electrical charge for causing electrostatic drawing relatively easily.

However, PTL 2 has problems. The raw material liquid is extruded from the extrusion elements 101 by centrifugal force created by the rotation of the spray head 102. At this time, a large amount of the raw material liquid contained on the inner side of the extrusion elements 101 is also subjected to the centrifugal force. Due to the centrifugal force, a large amount of the raw material liquid is often extruded at one time, and the extrusion of the raw material liquid is frequently interrupted. If it is interrupted, for example, the raw material liquid extruded from the extrusion elements 101 may not given a sufficient electrical charge right after an interruption, or the liquid may build up, thereby making the concentration of the electrical charge difficult. As a result, the raw material liquid is unlikely to be drawn, or the raw material liquid is not drawn at all so the raw material liquid itself adheres to the surrounding collecting member.

According to the technique of PTL 3, it is also difficult to make the amounts of the raw material liquid 114 extruded from the respective orifices 113 constant. Thus, similar problems occur.

That is, as illustrated in FIG. 10, the raw material liquid 114 is supplied dropwise into the container 111 from the holes 112*a* of the supply pipe 112. Since the raw material liquid 114 has low flowability, it accumulates unevenly on the inner peripheral wall of the container 111. If the thickness of the raw material liquid 114 accumulated on the inner peripheral wall is uneven, the centrifugal force exerted on the raw material liquid 114 extruded from the orifices 113 also becomes uneven. Hence, the amount of the raw material liquid 114 extruded from the respective orifices 113 varies, so the extrusion may be interrupted or the amount of the raw material liquid 114 extruded may exceed the intended amount. As a result, the density of electrical charge given to the raw material liquid 114 may become insufficient. As such, the droplets of the raw material liquid 114 solidify without being electrostatically drawn, and the solidified clumps are included in nanofibers.

In the case of the method of PTL 4, the amount of the raw material liquid supplied into the container 121 also varies. Even if the variation is within a specified range, the amount of the raw material liquid extruded varies significantly. In addition, the container is rotated at a high speed, and both centrifugal force by the rotation and force by gravity are exerted on the raw material liquid in the container. As a result, the raw material liquid is distributed unevenly in the container. This makes it difficult to completely prevent formation of clumps of the raw material not electrostatically drawn.

In view of the above problems, an object of the invention is to provide a method and apparatus for producing high quality nanofibers containing no clumps of raw material not electrostatically drawn with a high production efficiency.

Solution to Problem

The invention provides a method for producing nanofibers. The method includes the steps of:

rotating a container having a plurality of orifices in an outer peripheral wall;

extruding an electrically charged raw material liquid containing a polymer material from the orifices of the container by centrifugal force; and allowing the extruded raw material liquid to form a fibrous material. The container has a space communicating with the orifices, and the extruding step includes pressurizing the raw material liquid filled in the space.

Also, the invention provides an apparatus for producing nanofibers. The apparatus includes:

a rotary container including: a tubular outer peripheral wall with a plurality of orifices for extruding a raw material liquid containing a polymer material in a radial direction by centrifugal force, at least an opening of each orifice being made of a conductor; and a space communicating the orifices;

a rotary drive for rotating the container;

a pressure application device for pressurizing the raw material liquid filled in the space;

an electrode spaced apart from the container for a predetermined distance;

a potential-difference generating device for creating a potential difference between the container and the electrode to generate an electric field between the container and the electrode; and a collecting device for collecting a fibrous material formed from the raw material liquid electrically charged due to an electrical charge induced on the container and extruded from the orifices.

Advantageous Effects of Invention

According to the invention, with a raw material liquid being filled in a space that is formed in a container so as to communicate with a plurality of orifices in the peripheral wall of the container, the raw material liquid in the space is pressurized to extrude the raw material liquid from the orifices. This allows the raw material liquid to be extruded in a constant amount without being interrupted. Hence, the density of electrical charge given to the raw material liquid can be made constant. As a result, it is possible to produce larger amounts of high quality nanofibers containing no clumps of the raw material not electrostatically drawn.

DESCRIPTION OF EMBODIMENTS

Embodiments of the invention are hereinafter described in detail with reference to drawings.

Embodiment 1

Figure 1:
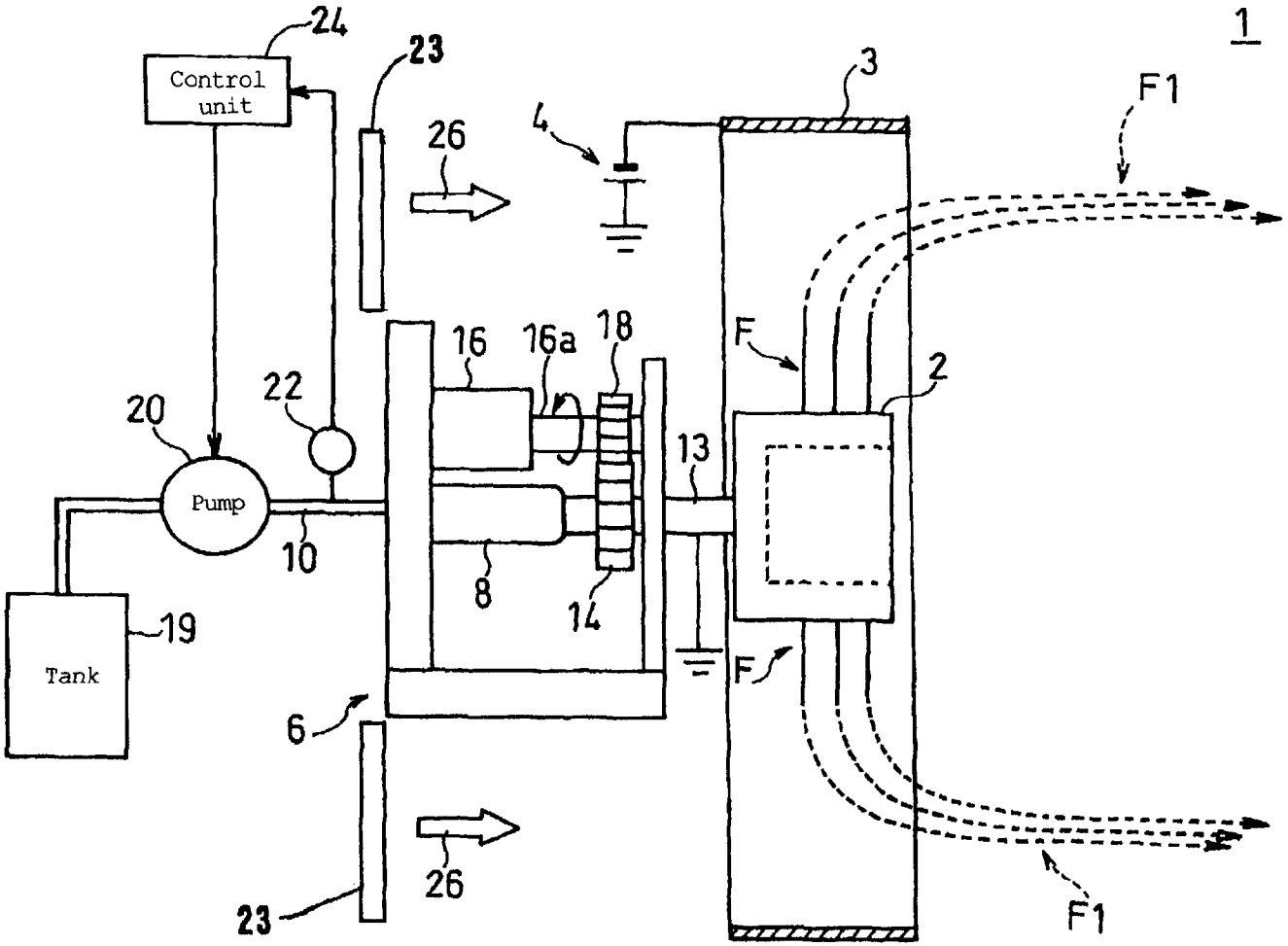
FIG. 1 is a partially sectional side view schematically showing the structure of a nanofiber production apparatus according to Embodiment 1 of the invention.
Figure 2:
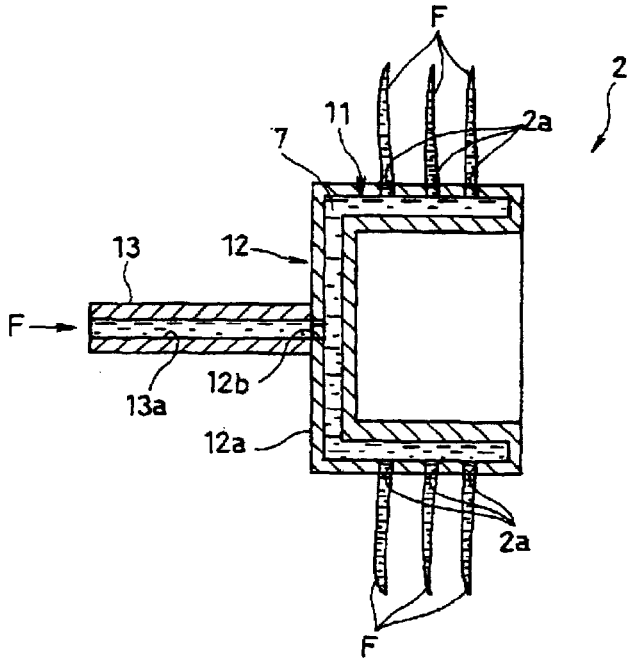
FIG. 2 is a sectional view showing the detail of a container used in the apparatus of FIG. 1.

FIG. 1 is a partially sectional side view schematically showing the structure of a nanofiber production apparatus according to Embodiment 1 of the invention. FIG. 2 is a sectional view showing the detail of a container.

A production apparatus 1 includes a substantially cylindrical container 2 made of a conductor such as a metal. The container 2 has an inner space for temporarily holding a raw material liquid F which comprises a polymer material (a raw material for nanofibers) dispersed or dissolved in a predetermined dispersion medium or solvent. The peripheral wall of the container 2 has a large number of orifices 2*a* (see FIG. 2) which communicate with the inner space and from which the raw material liquid F held in the inner space is extruded. The container 2 is a rotary container which is supported rotatably about the axis of the cylindrical shape as the central axis. Due to the centrifugal force, the raw material liquid F held in the inner space of the container 2 is extruded from the orifices 2*a*.

Also, an annular electrode 3, which is shaped like a ring produced by joining both ends of a long plate in the longitudinal direction, is coaxially disposed around the container 2 so that the inner face of the annular electrode 3 faces the outer face of the container 2 with a certain distance therebetween.

The annular electrode 3 is connected to one terminal (the negative terminal in the illustrated example) of a high voltage power source 4. Also, the other terminal (the positive terminal in the illustrated example) of the high voltage power source 4 is grounded. The container 2 is grounded. As such, an electrical charge of opposite polarity is induced on each of the outer face of the container and the inner face of the annular electrode 3, so that an electric field is generated therebetween.

The raw material liquid F extruded from the orifices 2*a* is given an electrical charge at the openings of the orifices 2*a*. While the charged raw material liquid F is traveling in the air, the solvent evaporates and the repulsive Coulomb force therein increases, so that the charged raw material liquid F is continuously electrostatically drawn and subdivided into fibers. In this manner, a fibrous material F1 is formed from the raw material liquid F through electrostatic drawing.

Preferably, the orifices 2*a* are formed regularly in the peripheral wall of the container 2. For example, they are preferably aligned at an equal interval in the axial direction of the container 2 and an equal pitch in the circumferential direction.

FIG. 2 shows the detail of the container 2. As illustrated in FIG. 2, the container 2 has a cylindrical peripheral wall part 11 with a double-walled structure having an inner space and a circular wall part 12 with a double-walled structure having an inner space. One end of the peripheral wall part 11 is joined to the circumference of the circular wall part 12, and the inner space of the peripheral wall part 11 communicates with the inner space of the circular wall part 12 at the joint thereof. These spaces communicating with each other constitute a raw material liquid introduction space 7 to which the raw material liquid is to be introduced.

Further, one end of a raw material liquid supply pipe 13 serving as the rotation axis is attached to the center of the circular wall part 12 of the container 2 perpendicularly to the circular wall part 12. A passage 13*a* of the raw material liquid supply pipe 13 and the raw material liquid introduction space 7 of the container 2 communicate with each other through a connection hole 12*b* made in the center of an outer side wall 12*a* of the circular wall part 12.

The raw material liquid supply pipe 13 is rotatably supported by a support unit 6, as illustrated in FIG. 1. The support unit 6 includes a rotary joint 8 and an electric motor 16. The other end of the raw material liquid supply pipe 13 is connected to one end of the rotary joint 8. The other end of the rotary joint 8 is connected to one end of a raw material liquid tube 10. The raw material liquid supply pipe 13 and the raw material liquid tube 10 communicate with each other through the rotary joint 8. Also, the raw material liquid supply pipe 13 is fitted with a passive gear 14. The passive gear 14 meshes with an active gear 18 installed on an output shaft 16*a* of the electric motor 16. With this structure, due to rotation output by the electric motor 16, the raw material liquid supply pipe 13 is rotated to rotate and drive the container 2.

The other end of the raw material liquid tube 10 is connected to a raw material liquid tank 19. Also, the raw material liquid tube 10 is fitted with a raw material liquid pump 20 and a pressure sensor 22. The raw material liquid pump 20 causes the raw material liquid F in the raw material liquid tank 19 to be transported to the container 2 through the rotary joint 8 and the raw material liquid supply pipe 13. The pressure sensor 22 is disposed downstream of the raw material liquid pump 20 in the raw material liquid tube 10. It detects the pumping pressure of the raw material liquid pump 20 and outputs a signal depending on the detection result. The signal output by the pressure sensor 22 is input into a control unit 24.

Based on the detection result by the pressure sensor 22, the control unit 24 controls the raw material liquid pump 20 so that the pumping pressure of the raw material liquid pump 20 becomes a predetermined pressure. The raw material liquid pump 20 preferably has a pressure regulation valve so that it is capable of supplying the raw material liquid F, which contains a solvent or dispersion medium with a low boiling point, to the container 2 at a constant pressure. Also, the AC motor (induction motor or synchronous motor) of the raw material liquid pump 20 is preferably capable of variable speed/torque control using an inverter.

With this structure, the raw material liquid F is supplied to the raw material liquid introduction space 7 of the container 2 from the raw material liquid tank 19 through the raw material liquid tube 10, the rotary joint 8, and the raw material liquid supply pipe 13 at a predetermined pressure. As a result, the raw material liquid F in the raw material liquid introduction space 7 is pressurized.

Also, as illustrated in FIG. 2, of the raw material liquid introduction space 7 of the container 2, the inner space of the peripheral wall part 11 having the orifices 2*a* preferably has a uniform depth in the radial direction so that the centrifugal force exerted on the raw material liquid F extruded from the orifices 2*a* becomes uniform. In this case, the extrusion pressure of the raw material liquid from the orifices by centrifugal force becomes uniform. As a result, the amount of the raw material liquid extruded can be made uniform. That is, the amounts of the raw material liquid F extruded from the respective orifices 2*a* become constant without varying with time, and the amounts of the raw material liquid F extruded from the respective orifices 2*a* become equal and uniform.

Also, since the amount of the raw material liquid adjacent to the openings of the orifices can be kept in a predetermined amount, it is possible to reduce the impact of uneven exertion of rotation-induced centrifugal force on the adjacent raw material liquid. As a result, the amount of the raw material liquid extruded can be made more constant.

In FIG. 1, the raw material liquid F and the fibrous material F1 are differentiated for convenience sake. However, in the actual production of nanofibers, the difference between the raw material liquid F and the fibrous material F1 is vague, and it is difficult to differentiate them clearly. Therefore, in the following description, only when they need to be differentiated, they are specified as the raw material liquid F and the fibrous material F1; otherwise, the raw material liquid F and the fibrous material F1 are generically expressed as the raw material liquid F or the like.

One or more blowers 23 are installed on the side (the left side in the illustrated example) of the container 2 where the raw material liquid supply pipe 13 is installed. Due to air streams 26 produced by the blowers 23, the direction in which the raw material liquid F or the like travels is deflected to a direction (axial direction of the container 2) substantially perpendicular to the extrusion direction (radial direction of the container 2). A collector (not shown) for collecting the fibrous material F1 is disposed in the direction (right direction in the illustrated example) into which the raw material liquid F or the like is deflected. This collector has a similar structure to a collector 5 used in Embodiment 3 below, and will be detailed in Embodiment 3.

Next, the operation of the nanofiber production apparatus having the above-described structure is described.

The raw material liquid F in the raw material liquid tank 19 is supplied to the raw material liquid introduction space 7 of the container 2 by the raw material liquid pump 20 through the raw material liquid tube 10, the rotary joint 8, and the raw material liquid supply pipe 13 at a predetermined pressure. As a result, the raw material liquid F is pressurized in the raw material liquid introduction space 7. Also, the container 2 is rotated at a predetermined speed by the rotation output by the electric motor 16. The raw material liquid F supplied to the raw material liquid introduction space 7 of the container 2 is extruded from the orifices 2*a* by the centrifugal force by the rotation of the container 2 and the supply pressure of the raw material liquid F by the raw material pump 20. Also, an electrical charge of opposite polarity is induced on each of the grounded container 2 and the annular electrode 3 to which a high voltage is applied by the power source 4. In the illustrated example, a positive charge is induced on the container 2, while a negative charge is induced on the annular electrode 3.

The raw material liquid F extruded from the orifices 2*a* by the centrifugal force and the supply pressure of the raw material liquid F becomes charged due to the electrical charge induced on the container 2. The charged raw material liquid F is attracted to the annular electrode 3 due to the electric field between the container 2 and the annular electrode 3.

The raw material liquid F is extruded radially from the orifices 2*a* toward the annular electrode 3 by the supply pressure, the centrifugal force, and the electric field. While the raw material liquid F extruded from the orifices 2*a* is traveling in the air, the dispersion medium or solvent evaporates, so that the volume of the raw material liquid F decreases and the charge density gradually increases. When the repulsive Coulomb force in the raw material liquid F overcomes the surface tension, electrostatic drawing occurs, and as a result of repetition of this phenomenon, the raw material liquid F is subdivided into fibers. In this manner, the fibrous material F1 (nanofibers) is formed.

The direction in which the raw material liquid F extruded form the orifices 2*a* or the fibrous material F1 formed therefrom travels is changed to a direction (axial direction of the container 2) substantially perpendicular to the extrusion direction (radial direction of the container 2) by the air streams 26 and is transported to the collector.

As described above, in Embodiment 1, the raw material liquid F is supplied to the raw material liquid introduction space 7 at a constant pressure by the raw material liquid pump 20, so that the raw material liquid F to be extruded from the orifices 2*a* by the centrifugal force is pressurized by the supply pressure by the raw material liquid pump 20. This makes it possible to extrude the raw material liquid F from the orifices 2*a* without interruption. Also, since a constant pressure is applied to the raw material liquid introduction space 7 communicating with the orifices 2*a*, the amounts of the raw material liquid F extruded from the respective orifices 2*a* can be made uniform. Further, as illustrated in FIG. 2, all the positions of the raw material liquid introduction space 7 with the orifices 2*a* are equally distant from the rotation axis of the container 2, and have a uniform depth in the radial direction. This makes it possible not only to make the centrifugal force exerted on the raw material liquid F extruded from the orifices 2*a* constant but also to make the centrifugal force exerted on the raw material liquid F contained on the inner side of the orifices 2*a* constant. As a result, the flow rate of the raw material liquid F extruded from the orifices 2*a* can be made constant.

Thus, the density of electrical charge given to the raw material liquid F can also be made constant. This helps prevent the problem of clumps made from a part of the raw material liquid being collected by the collector without being electrostatically drawn. Such problem is more likely to occur when the revolution frequency of the container 2 is heightened. However, heightening the revolution frequency of the container 2 results in an increase in the amount of the raw material liquid F extruded. Thus, productivity improves.

Accordingly, the apparatus of FIG. 1 can produce high quality nanofibers containing no clumps of raw material with a higher productivity (see Examples below).

Figure 3:
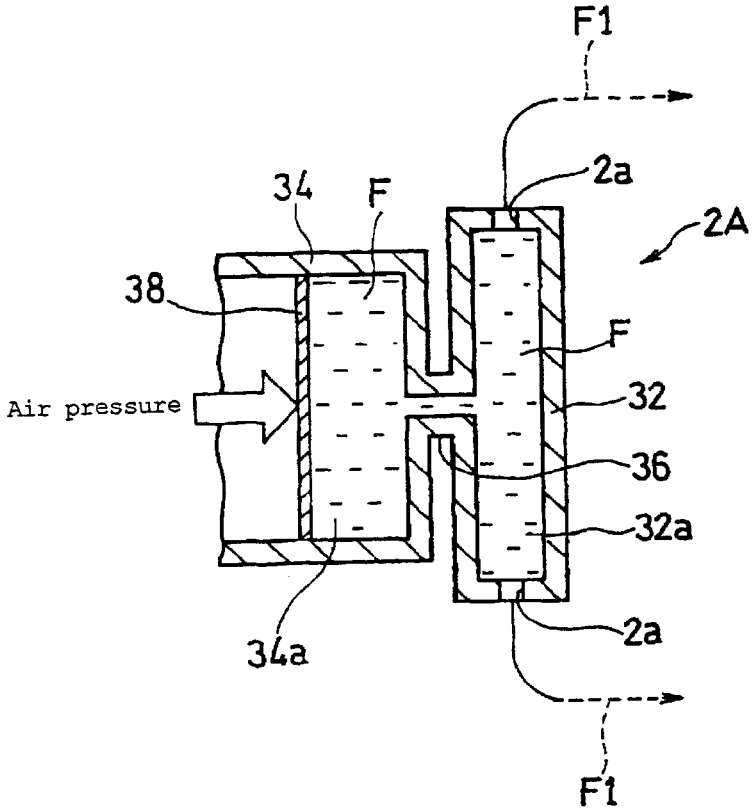
FIG. 3 is a sectional view showing the detail of anther container which can be substituted for the container of FIG. 2.

It should be noted that the container 2 is not limited to the structure illustrated in FIG. 2 and can be modified in various manners within the scope of the invention. For example, the container 2 can be replaced with a container 2A illustrated in FIG. 3. The container 2A includes a raw material liquid extrusion part 32 having a row of orifices 2*a* in the peripheral wall and a pressure application part 34 for pressurizing the raw material liquid F to supply the raw material liquid F to an inner space 32*a* of the raw material liquid extrusion part 32 at a predetermined pressure.

The raw material liquid extrusion part 32 and the pressure application part 34 are substantially cylindrical, and the inner space 32*a* and an inner space 34*a* communicate with each other through a connection part 36. The pressure application part 34 contains a circular pressing member 38 whose outer diameter is slightly smaller than the inner diameter of the pressure application part 34. The pressing member 38 pressurizes the raw material liquid F in the pressure application part 34 by the pressure of air supplied from an air pump (not shown), to transport the raw material liquid F to the space 32*a* of the raw material liquid extrusion part 32. The raw material liquid F transported to the space 32*a* of the raw material liquid extrusion part 32 is extruded from the orifices 2*a* in the peripheral wall of the raw material liquid extrusion part 32.

The raw material liquid F can be pressurized by not only the air pressure but also the supply pressure of the raw material liquid F by the pump 20 as in the case of the container 2 (FIG. 2). In this case, the pressing member 38 is not necessary.

The container 2 or 2A (hereinafter generically referred to as the "container 2") desirably has an outer diameter of 10 mm to 300 mm. If the diameter of the container 2 is more than 300 mm, it is difficult for the air streams to concentrate the raw material liquid F or the like to a suitable extent. Also, if the diameter of the container 2 is more than 300 mm, the support structure for supporting the container 2 needs to have a significantly high rigidity to allow the container 2 to rotate stably, thereby making the apparatus large. On the other hand, if the diameter of the container is less than 10 mm, the revolution frequency needs to be heightened to produce sufficient centrifugal force for extruding the raw material liquid. As a result, the load and vibrations of the motor increase, thereby necessitating anti-vibration and other measures. In view of the above points, the more preferable outer diameter of the container 2 is 20 to 100 mm.

Also, the orifices 2*a* desirably have a diameter of 0.01 to 2 mm. Also, the orifices 2*a* are preferably circular in shape, but may be polygonal, star-shaped, etc. Also, the revolution frequency of the container 2 can be adjusted in the range of, for example, 1 rpm or more and 10,000 rpm or less, depending on the viscosity of the raw material liquid F, the composition of the raw material liquid F (kind of the polymer material), and the diameter of the orifices 2*a*.

Also, the annular electrode 3 desirably has an inner diameter of, for example, 200 to 1000 mm.

Also, it is preferable to apply a voltage of 1 to 200 kV to the annular electrode 3 from the power source 4. It is more preferable to apply a high voltage of 10 kV or more and 200 kV or less. To obtain high quality nanofibers, the intensity of the electric field between the container 2 and the annular electrode 3 is particularly important. It is preferable to set the voltage applied and dispose the annular electrode 3 so that the intensity of the electric field is 1 kV/cm or more. In this case, a uniform and strong electric field can be generated between the container 2 and the annular electrode 3.

The annular electrode 3 is not necessarily in the form of a circular ring, and may be, for example, polygonal when viewed from the axial direction. Also, the annular electrode 3 only needs to be disposed so as to surround the container 2 at a predetermined distance from the outer surface of the container 2; for example, an annular metal wire may be disposed so as to surround the container 2.

Also, it is preferable to dispose a heater (not shown) for heating the air streams 26 between the blowers for producing the air streams 26 and the container 2, in order to promote the evaporation of the dispersion medium or solvent from the raw material liquid F or the like to promptly produce the fibrous material F1 from the raw material liquid F. This promotes the evaporation of the charged raw material liquid F and the occurrence of electrostatic explosion. As a result, the fibrous material F1 produced has a smaller fiber diameter, and the microfibrous material F1 can be produced stably.

Also, it is desirable to dispose a tube (not shown) between the collector and the container 2 surrounded by the annular electrode 3 to define the flow path of the raw material liquid F or the like transported by the air streams. The tube desirably has such a shape that its opening facing the container 2 is smaller than its opening facing the collector and that the diameter gradually increases from upstream toward downstream. When the tube whose diameter gradually increases from upstream toward downstream is disposed between the container 2 and the collector to define the flow path of the raw material liquid F or the like so as to gradually enlarge the flow path, the fibrous material F1 can be collected uniformly and evenly with a high density.

In Embodiment 1, the container 2 is grounded, and a high voltage is applied to the annular electrode 3 from the power source 4. However, there is no limitation thereto, and it is also possible to apply a high voltage to the container 2 from the power source 4 and ground the annular electrode 3. In this case, however, a special mechanism becomes necessary for insulating the container 2 from the other components, since a high voltage is applied to the rotating container 2.

It is also possible to connect the container 2 and the annular electrode 3 to the two terminals of the power source 4 and apply a voltage to the container 2 and the annular electrode 3. In other words, any structure may be employed if the structure is capable of producing a potential difference between the container 2 and the annular electrode 3 to generate an electric field therebetween, thereby giving an electrical charge to the raw material liquid F extruded from the orifices 2*a*.

Preferable examples of the polymer material contained in the raw material liquid F include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, vinylidene fluoride-hexafluoropropylene copolymer, polyvinyl chloride, vinylidene chloride-acrylate copolymer, polyacrylonitrile, acrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, and polypeptide. At least one selected therefrom is used. However, the polymer material contained in the raw material liquid F is not limited to these, and any existing substances which will be found to be suitable as raw materials for nanofibers or newly developed substances which will be found to be suitable as raw materials for nanofibers may also be used advantageously.

Also, preferable examples of the dispersion medium or solvent in which the polymer material is to be dispersed or dissolved include methanol, ethanol, 1-propanol, 2-propanol, hexafluoroisopropanol, tetraethyleneglycol, triethyleneglycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, pyridine, and water. At least one selected therefrom is used. However, the dispersion medium or solvent in which the polymer material is to be dispersed or dissolved is not limited to these, and any existing substances which will be found to be suitable as the dispersion media or solvents for polymer materials in electrospinning or newly developed substances which will be found to be suitable as the dispersion media or solvents may be used advantageously.

Also, an inorganic solid material can be mixed into the raw material liquid F. Examples of inorganic solid materials which can be mixed thereinto include oxides, carbides, nitrides, borides, silicides, fluorides, and sulfides. In terms of heat resistance, processability, etc., the use of an oxide is preferable. Examples of oxides include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$, and at least one selected therefrom is used. However, the inorganic solid material mixed into the raw material liquid F is not limited to these.

With respect to the mixing ratio of the polymer material and the dispersion medium or solvent, the ratio of the dispersion medium or solvent is preferably 60 to 98 mass %, although it depends on the kinds thereof.

Embodiment 2

Figure 4:
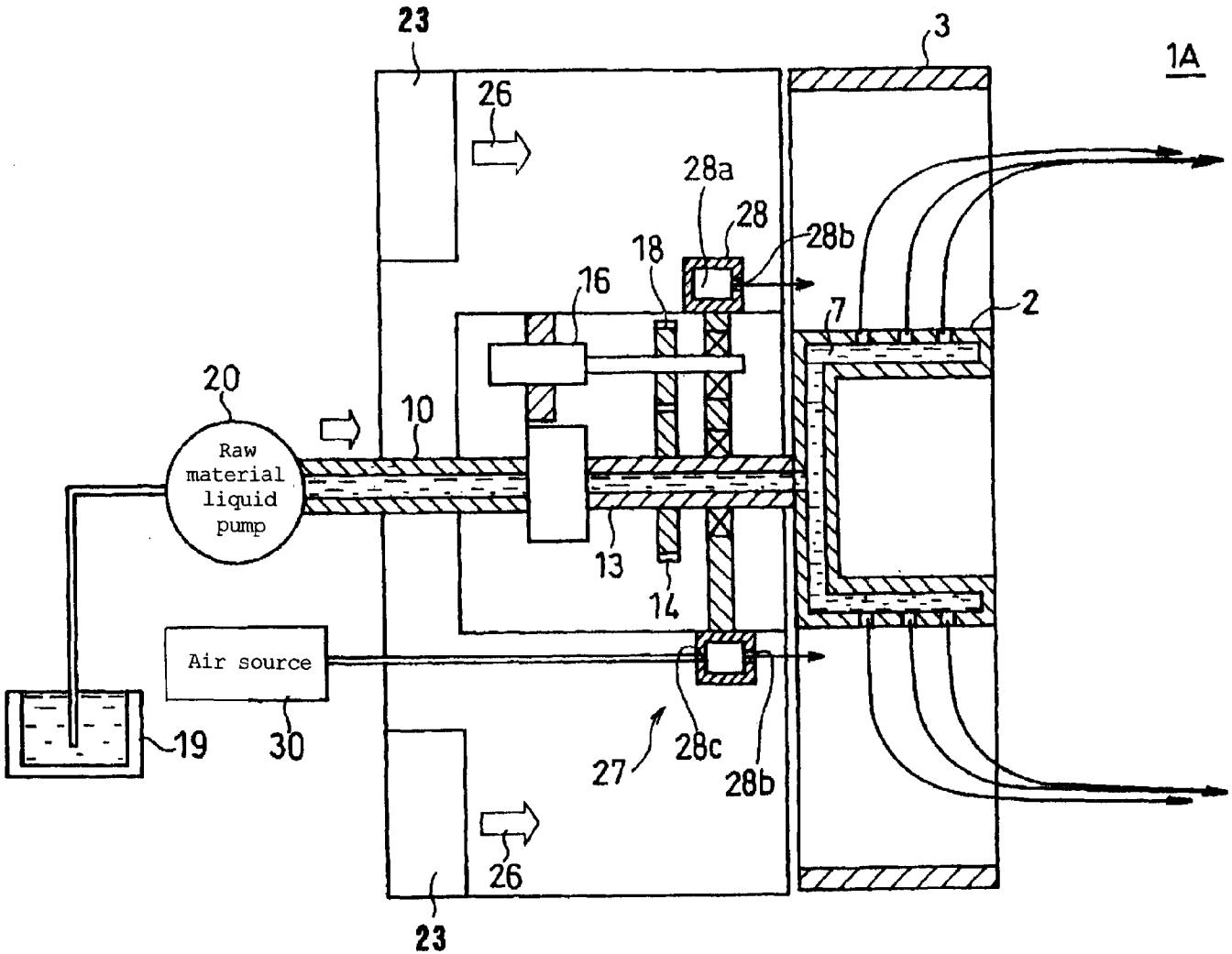
FIG. 4 is a partially sectional side view schematically showing the structure of a nanofiber production apparatus according to Embodiment 2 of the invention.

Referring now to FIG. 4, Embodiment 2 of the invention is described. Since Embodiment 2 is a modification of Embodiment 1, only the components different from those of Embodiment 1 are described.

FIG. 4 is a partially sectional side view of a nanofiber production apparatus according to Embodiment 2 of the invention. In Embodiment 2, the container 2 can also be replaced with the container 2A.

A nanofiber production apparatus 1A of Embodiment 2 has two kinds of air stream generating means to prevent the raw material liquid F extruded from the orifices 2*a* of the container 2 from adhering to the annular electrode 3 in a more reliable manner. In Embodiment 1, the annular electrode 3 is disposed around the container 2 to give a sufficient electrical charge to the raw material liquid F extruded from the container 2. However, the annular electrode 3 is disposed in the extrusion direction of the raw material liquid F from the container 2. Thus, merely deflecting the raw material liquid F or the like by using the air streams 26 produced by the blowers may allow a part of the raw material liquid F or the like to adhere to the annular electrode 3. If the raw material liquid F or the like adheres to the annular electrode 3, regular maintenance becomes necessary to remove it, thereby resulting in decreased production efficiency.

Embodiment 2 uses two kinds of air stream generating means to minimize the amount of the raw material liquid F or the like adhering to the annular electrode 3, thereby decreasing the frequency of maintenance and increasing the production efficiency.

One of the two kinds of air stream generating means is the blowers 23 used for producing the air streams 26 in Embodiment 1. The other is a gas ejection mechanism 27. The gas ejection mechanism 27 is composed of a ring-shaped gas ejection part 28 whose inner diameter is slightly larger than the outer diameter of the container 2, and an air source 30 comprising, for example, an air pump, for supplying an ejection gas (e.g., air) to the gas ejection part 28. The gas ejection part 28 has such a structure obtained by joining both ends of a hollow, rectangular member to form a ring.

More specifically, the gas ejection part 28 has: a hollow part 28*a* into which the gas is introduced from the air source 30; a plurality of ejection holes 28*b* formed in a side face at a predetermined pitch for ejecting the gas in one direction along the axial direction; and an air introduction hole 28*c* for introducing the gas into the hollow part 28*a* from the air source 30. The gas supplied to the gas ejection part 28 from the air source 30 at a predetermined pressure is ejected from the respective ejection holes 28*b* toward the raw material liquid F extruded from the orifices 2*a* of the container 2.

The gas ejection mechanism 27 with such a structure is capable of easily increasing the velocity of the ejected gas, thus being capable of effectively deflecting the raw material liquid F extruded radially from the orifices 2*a* of the container 2.

As described above, the two kinds of air stream generating means prevent adhesion of the raw material liquid F or the like to the annular electrode 3 in a more reliable manner. It should be noted that a similar effect can also be obtained by ejecting a gas from a slit (not shown) that is formed in a side face of the gas ejection part 28 so as to extend entirely around the side face, instead of the ejection holes 28*b*.

Embodiment 3

Figure 5:
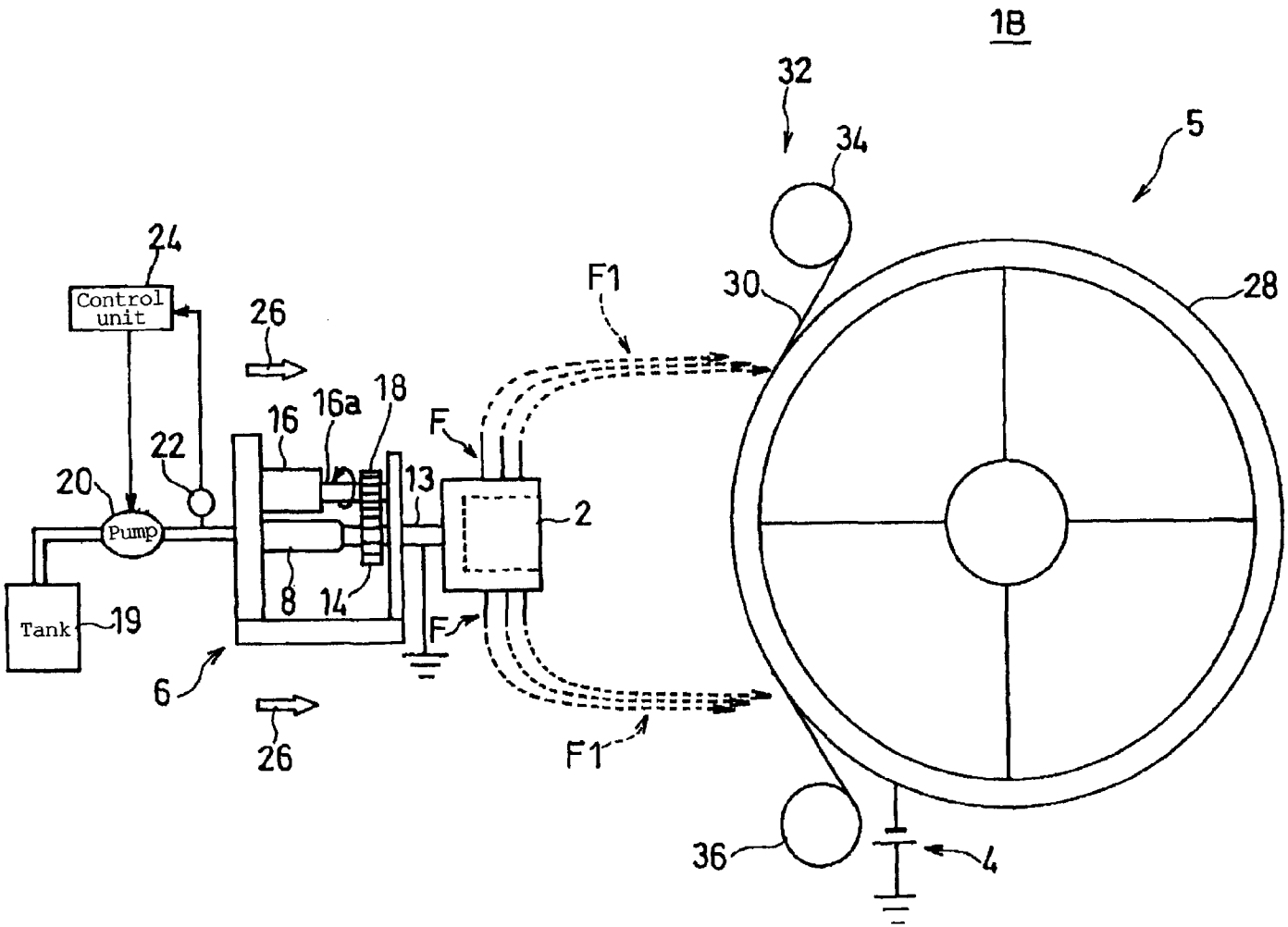
FIG. 5 is a partially sectional side view schematically showing the structure of a nanofiber production apparatus according to Embodiment 3 of the invention.

Referring now to FIG. 5, Embodiment 3 of the invention is described. Since Embodiment 3 is a modification of Embodiment 1, only the components different from those of Embodiment 1 are described. FIG. 5 is a schematic side view of the structure of a nanofiber production apparatus according to Embodiment 3 of the invention. In Embodiment 3, the container 2 can also be replaced with the container 2A.

In a nanofiber production apparatus 1B of Embodiment 3, the annular electrode 3 is not used, and a drum 28 of a collector 5 for collecting the fibrous material F1 is used as the electrode opposed to the container 2.

As mentioned above, the collector 5 is disposed in the direction into which the raw material liquid F or the like is deflected by the air streams 26, and has the drum 28 made of a conductor. One terminal (positive terminal in the illustrated example) of a high voltage power source 4 is grounded, and the other terminal (negative terminal in the illustrated example) is connected to the drum 28. Also, the container 2 is grounded, so an electric field occurs between the container 2 and the drum 28. As a result, an electrical charge of opposite polarity is induced on each of the container 2 and the drum 28. In the illustrated example, a negative charge is induced on the drum 28, while a positive charge is induced on the container 2.

A long-strip like collecting member 30 is disposed between the container 2 and the drum 28. The collecting member 30 is a flexible member transported in the longitudinal direction by a transport mechanism 32 so as to slide over the outer surface of the drum 28. The fibrous material F1 formed from the raw material liquid F is deposited on the surface of the collecting member 30 transported in the longitudinal direction and is collected as non-woven fabric. The transport mechanism 32 includes a supply roll 34 for supplying the collecting member 30 and a take-up roll 36 for taking up the collecting member 30 on which the fibrous material F1 is collected.

The collecting member 30 is preferably made of a thin, flexible material so that the air streams 26 transporting the fibrous material F1 (nanofibers) formed from the raw material liquid F are capable of passing therethrough and that the deposited fibrous material F1 can be easily separated therefrom. A preferable example of such material is a mesh sheet made from an aramid fiber. It is preferable to coat this with Teflon®, since the fibrous material F1 (nanofibers) can be separated more easily.

The collecting member 30 is usually made of an insulating material, but is not limited thereto. A conductive material such as carbon nanofibers may be mixed into a long sheet to make the collecting member 30 conductive.

As described above, the drum 28 of the collector 5 for collecting the fibrous material F1 is used as the electrode opposed to the container 2, instead of the annular electrode 3. This prevents the raw material liquid F or the produced fibrous material F1 from adhering to the annular electrode 3, thereby eliminating the need for maintenance. As a result, the production efficiency is improved. However, it is difficult to dispose the electrode close to the container 2, so the productivity may slightly lower compared with Embodiment 1.

Figure 6:
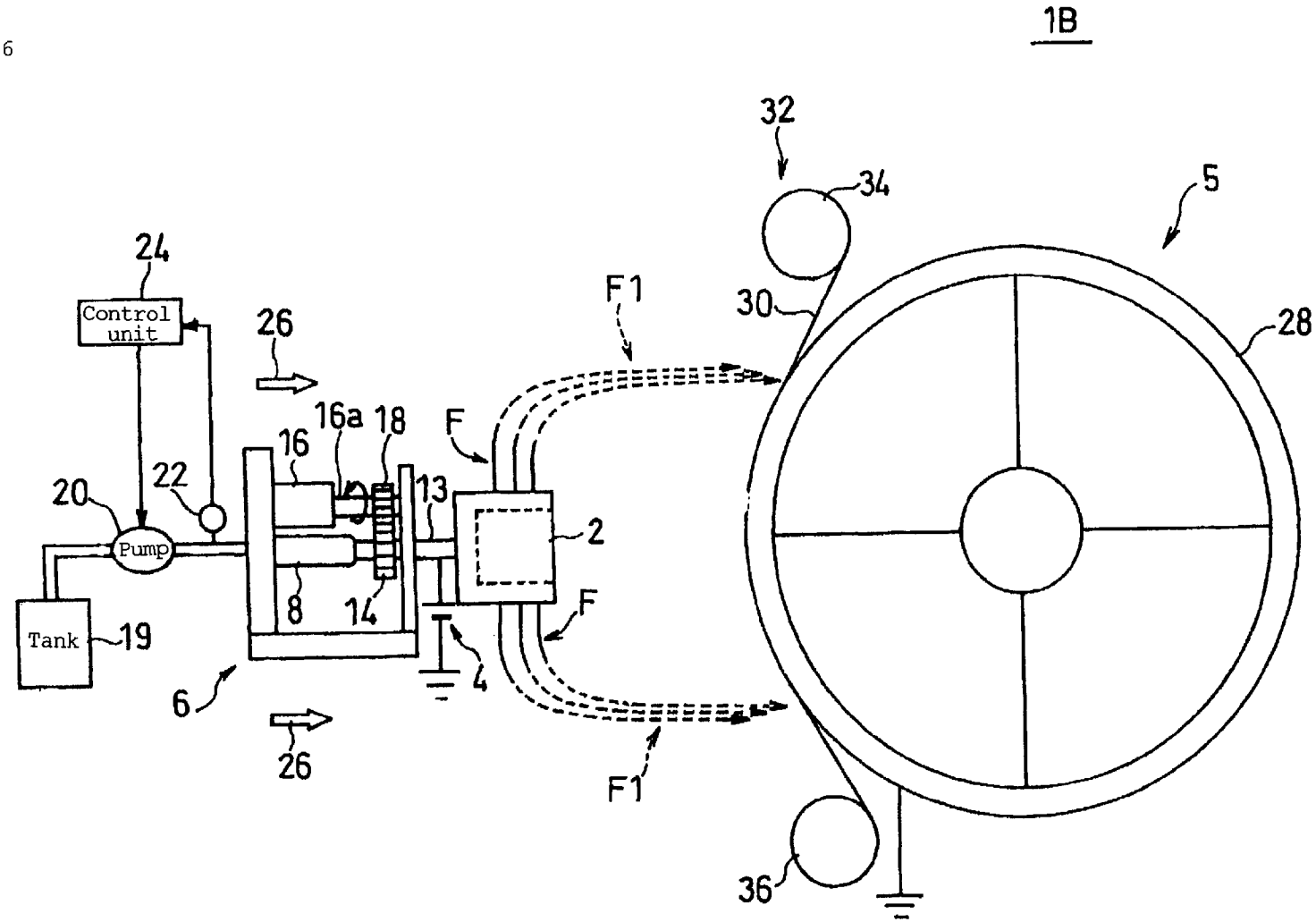
FIG. 6 is a partially sectional side view of a modified example of the apparatus of FIG. 4.

As illustrated in FIG. 6, in Embodiment 3, it is also possible to apply a high voltage to the container 2 from the power source 4 and ground the drum 28. In this case, however, a special mechanism becomes necessary for insulating the container 2 from the other components. In addition, the structure of Embodiment 2 and the structure of Embodiment 3 can be combined together.

Embodiment 4

Figure 7:
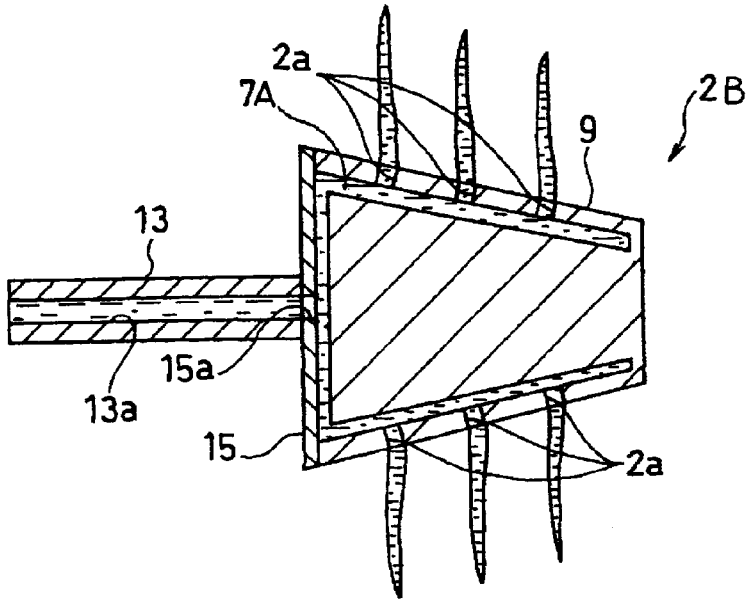
FIG. 7 is a sectional view showing the detail of a container for a nanofiber production apparatus according to Embodiment 6 of the invention.

Referring now to FIG. 7, Embodiment 4 of the invention is described. Since Embodiment 4 is a modification of Embodiment 1, only the components different from those of Embodiment 1 are described. FIG. 7 is a sectional view showing the detail of a container for a nanofiber production apparatus according to Embodiment 4 of the invention.

A container 2B used in Embodiment 4 has an outer shape obtained by cutting off a top part from a cone whose outer diameter changes linearly in the direction of rotation axis. A raw material liquid introduction space 7A of the container 2B is composed of: a space with a uniform depth from the surface of a peripheral wall 9 and a uniform depth in the radial direction; and a space with a uniform depth from the surface of a circular wall 15 (which corresponds to the base plane of the cone) and a uniform depth in the axial direction. The raw material liquid introduction space 7A on the inner side of the peripheral wall 9 becomes closer to the rotation axis of the container 2B as its position becomes closer to the tip side of the container 2B (right side in the figure).

A raw material liquid supply pipe 13 is connected to the center of the outer surface of the circular wall 15. A passage 13*a* of the raw material liquid supply pipe 13 and the raw material liquid introduction space 7A of the container 2A communicate with each other through a connection hole 15*a* formed in the center of the circular wall 15.

When the container 2B of Embodiment 4 is used, the centrifugal force exerted on the raw material liquid F extruded from the orifices 2*a* decreases toward downstream of the air streams 26. Thus, the flow paths of the raw material liquid F or the like deflected by the air stream 26 become inward in the radial direction toward downstream of the air streams 26. As a result, the flow paths of the raw material liquid F or the like extruded from the respective orifices 2*a* are dispersed in the radial direction of the container 2A. If the flow paths of the raw material liquid F or the like are concentrated without being dispersed in the radial direction of the container 2A, problems occur. For example, the raw material liquid F extruded from the downstream orifices 2*a* is inhibited from becoming charged due to the electrical charge it has, or the extrusion of the raw material liquid F from the downstream orifices 2*a* is hindered. As such, by dispersing the flow paths of the raw material liquid F or the like in the radial direction of the container 2B, these problems can be eliminated.

When the outer diameter of the container 2B is decreased toward downstream of the air streams 26 as illustrated in FIG. 7, it is preferable to increase the diameter of the orifices 2*a* toward downstream of the air streams 26 so that the flow rates of the raw material liquid F extruded from the respective orifices 2*a* are uniform. In this case, the fiber diameter of the fibrous material F1 produced can be made uniform.

The container 2B of this embodiment is applicable to not only Embodiment 1 but also Embodiments 2 and 3. In this case, essentially the same effects can also be obtained.

Also, the outer diameter of the container 2B is linearly decreased toward downstream of the air streams 26, but it can also be increased. In this case, the flow paths of the raw material liquid F or the like deflected by the air streams 26 can also be dispersed in the radial direction of the container 2A.

EXAMPLES

Examples of the invention are hereinafter described. However, the invention is not to be construed as being limited to the following examples.

A total of 108 orifices 2*a* were formed in the peripheral wall of a substantially cylindrical container 2 with an outer diameter of 60 mm and an inner diameter of 57 mm. Specifically, a row of six orifices 2*a* was aligned in the axial direction of the container 2, and 18 rows were aligned in the circumferential direction of the container 2. At this time, the pitch of the orifices 2*a* in the circumferential direction of the container 2 was approximately 20 mm. Also, the pitch of the orifices 2*a* in the axial direction of the container 2 was 10 mm.

In this manner, three containers 2 having orifice 2*a* diameters of 0.20 mm (Example 1), 0.30 mm (Example 2), and 0.50 mm (Example 3) were produced.

These three containers 2 were incorporated into nanofiber production apparatuses (hereinafter referred to as apparatuses of Example) illustrated in FIG. 1, and the containers 2 were rotated for 20 minutes at various revolution frequencies to produce nanofibers. The diameter of the annular electrode 3 was set to 400 mm, and the voltage of the power source 7 was set to 60 kV. Its negative electrode was connected to the annular electrode 3, while the positive electrode was grounded. Also, the collecting member 30 was transported at a rate of 5 mm/min. Polyvinyl alcohol (PVA) was used as the polymer material, and water was used as the solvent. They are mixed to form a solution with a polyvinyl alcohol concentration of 10 mass % as the raw material liquid F.

Figure 10:
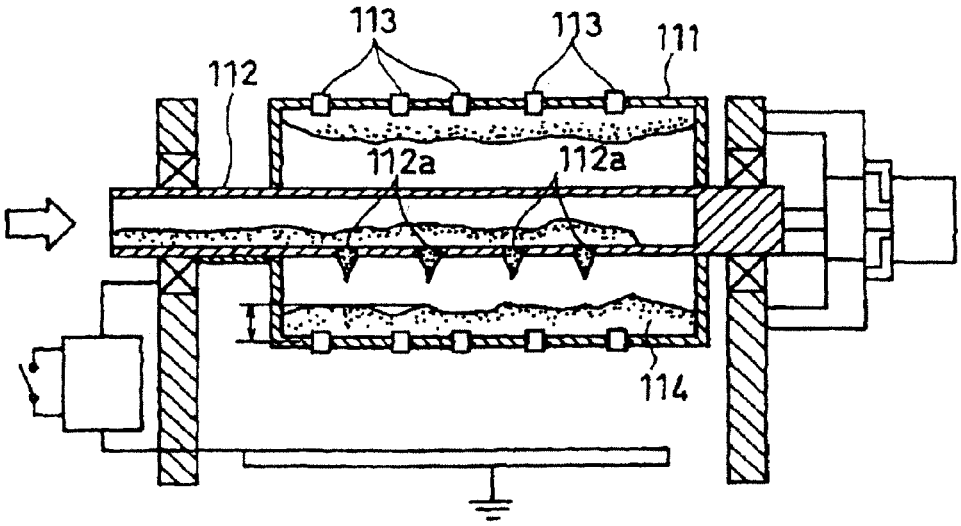
FIG. 10 Prior Art
FIG. 10 is a sectional view of the structure of another conventional nanofiber production apparatus.
Figure 11:
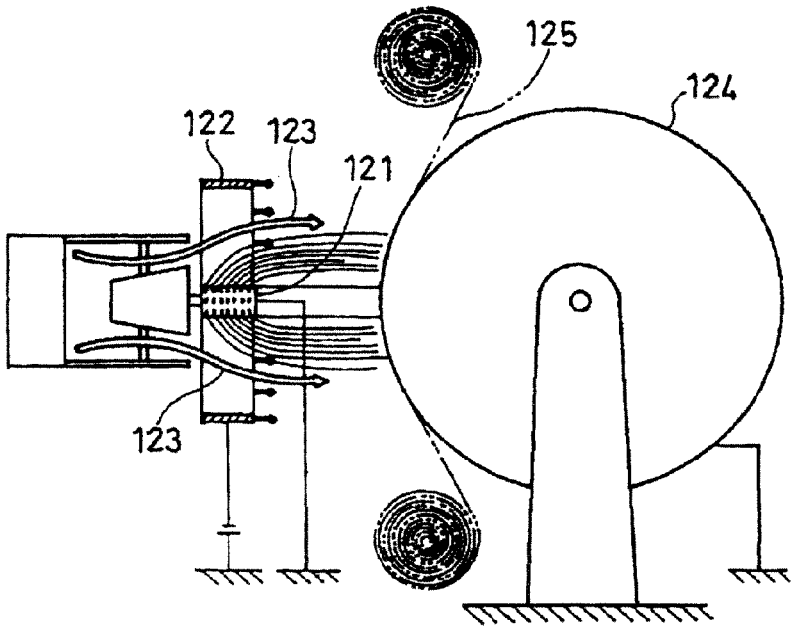
FIG. 11 Prior Art
FIG. 11 is a side view of a still another conventional nanofiber production apparatus.

Also, using conventional nanofiber production apparatuses of FIG. 10 with a container 111 and a supply pipe 112 (hereinafter referred to as the apparatuses of comparative examples), nanofibers were produced under the same conditions as those of Examples 1 to 3. As the container 111, three containers of the above-mentioned three kinds, having orifice 113 diameters of 0.20 mm (Comparative Example 1), 0.30 mm (Comparative Example 2), and 0.50 mm (Comparative Example 3), were prepared.

Figure 8:
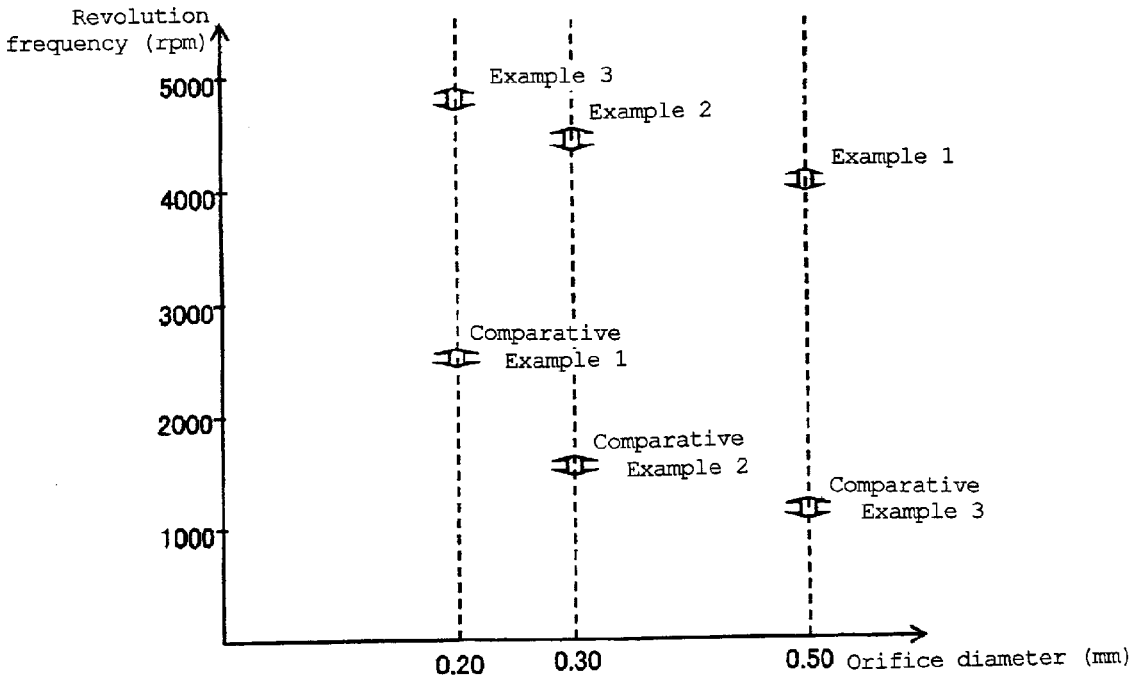
FIG. 8 is a graph showing the relationship between orifice diameter and revolution frequency for Examples of the invention and Comparative Examples.
Figure 9:
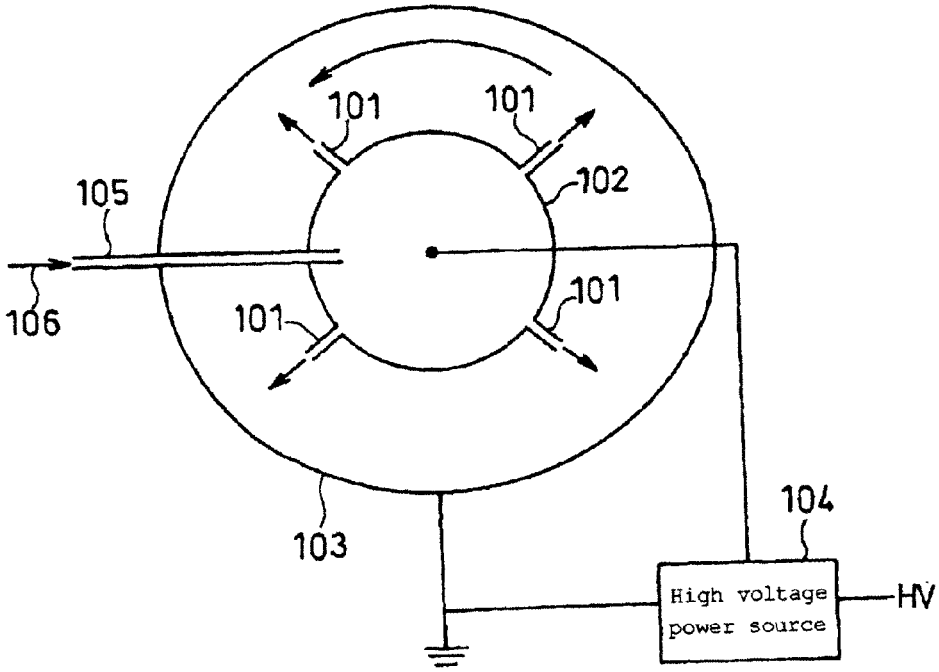
FIG. 9 Prior Art
FIG. 9 is a side view of a conventional nanofiber production apparatus.

The nanofibers produced in Examples 1 to 3 and Comparative Examples 1 to 3 were observed with a microscope to check whether high quality nanofibers containing no clumps of the polymer material could be produced. The results are shown in FIG. 8. In this figure, the hollow double-headed arrows show the upper limits of revolution frequency of the container 2 or container 111 up to which such high quality nanofibers could be produced.

As shown in FIG. 8, Examples 1 to 3, which have the same orifice 2*a* diameters as Comparative Examples 1 to 3, respectively, could produce high quality nanofibers containing no clumps of the raw material not electrostatically drawn even when the container 2 was rotated at higher revolution frequencies than those of Comparative Examples 1 to 3. This means that even when larger amounts of the raw material liquid F is extruded from the orifices 2*a*, high quality nanofibers can be produced. This indicates that according to the invention, larger amounts of high quality nanofibers can be produced.

This is probably because in Examples 1 to 3, the flow rates of the raw material liquid F extruded from the respective orifices 2*a* of the container 2 can be made constant. In other words, this is because the raw material liquid F extruded from the respective orifices 2*a* does not contain the raw material liquid F with an insufficient charge density until the revolution frequency reaches a higher value. This is also because the frequency with which the raw material liquid extruded from the orifices forms clumps is low until the revolution frequency reaches a higher value.

Also, the present inventors applied the respective containers 2 of Examples 1 to 3 to the nanofiber production apparatus 1A of Embodiment 2 to produce nanofibers under the same conditions as those of Examples 1 to 3, and checked the amount of the raw material liquid F or the like adhering to the annular electrode 3. As a result, in Examples 1 to 3, slight adhesion of the raw material liquid F or the like to the annular electrode 3 was found after a 20-minute operation. However, in the experiment using the nanofiber production apparatus 1A of Embodiment 2, almost no adhesion of the raw material liquid F or the like to the annular electrode 3 was found after a 20-minute operation. Thus, in a more preferable embodiment of the invention, the adhesion of the raw material liquid F or the like to the annular electrode 3 could be reduced.

In the above description of Embodiments and Examples, the orifices are formed directly in the outer peripheral wall of each container. However, the effects of the invention can also be obtained by forming protrusions such as nozzles on the outer peripheral wall, forming orifices at the tips of the protrusions, and extruding the raw material liquid from the orifices. That is, by limiting the amount of the raw material liquid adjacent to the orifices in the container to a predetermined amount, supplying the raw material liquid into the container at a predetermined pressure, and making the centrifugal force exerted on the predetermined amount of the raw material liquid constant, the amounts of the raw material liquid extruded from the respective orifices can be stably adjusted to a constant amount. As a result, it becomes possible to produce larger amounts of high quality nanofibers containing no clumps of raw material not electrostatically drawn.

INDUSTRIAL APPLICABILITY

According to the apparatus and method for producing nanofibers of the invention, when nanofibers are produced by electrospinning, high quality nanofibers can be produced with high productivity.

REFERENCE SIGNS LIST

1 Nanofiber Production Apparatus
2 Container
2*a* Orifice
3 Annular Electrode
4 High voltage power source
5 Collector
7 Raw Material Liquid Introduction Space
8 Rotary Joint
16 Electric Motor
19 Raw Material Liquid Tank
20 Raw Material Liquid Pump
22 Pressure Sensor
24 Control Unit
26 Air Stream
F Raw Material Liquid
F1 Fibrous Material

The invention claimed is:

1. A method for producing nanofibers, comprising steps of:

rotating a container comprising a cylindrical peripheral wall part with a double-walled structure which includes:

an inner space having uniform depth in a radial direction, for holding a raw material liquid containing a polymer material; and an outer peripheral wall having orifices for extrusion of the raw material liquid in a radial direction by centrifugal force, the container being rotated around an axis of the cylindrical peripheral wall part, and at least an opening edge of each of the orifices being made of a conductor;

pressurizing the raw material liquid filled in the inner space;

allowing the raw material liquid to be electrically charged with an electrical charge induced on the container, and then allowing the electrically-charged raw material liquid to be extruded from the orifices by a centrifugal force from the container rotation and by a pressure from the raw material liquid pressurization; and allowing the extruded raw material liquid to form a fibrous material by a Coulomb force from the electrical charge with which the raw material liquid has been electrically charged.

2. The method for producing nanofibers in accordance with claim 1, wherein the direction in which the raw material liquid is extruded from the orifices or in which the fibrous material formed from the extruded raw material liquid travels, is deflected from the direction of the centrifugal force, by air streams.

* * * * *